US006336951B1

(12) United States Patent
Qvick et al.

(10) Patent No.: US 6,336,951 B1
(45) Date of Patent: Jan. 8, 2002

(54) METHOD OF MAKING SUBMICRON CEMENTED CARBIDE CUTTING TOOL INSERTS

(75) Inventors: Jan Qvick, Virsbo; Bo Jansson, Hägersten, both of (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 09/252,976

(22) Filed: Feb. 19, 1999

(30) Foreign Application Priority Data

Feb. 20, 1998 (SE) ..... 9800496

(51) Int. Cl.[7] ..... B22F 3/12; C22C 1/05

(52) U.S. Cl. ..... 75/240; 419/18; 419/23; 419/32; 419/38

(58) Field of Search ..... 75/240; 419/18, 419/32, 38, 23

(56) References Cited

U.S. PATENT DOCUMENTS 4,923,512 A * 5/1990 Timm et al. ..... 75/239
4,950,328 A 8/1990 Odani et al. ..... 75/240
5,441,693 A 8/1995 Ederyd et al. ..... 419/10

FOREIGN PATENT DOCUMENTS

| | | |
|---|---|---|
| EP | 0380096 A1 | 8/1990 |
| JP | 51126309 | 4/1976 |
| JP | 59035937 | 2/1984 |
| JP | 61012847 | 1/1986 |
| JP | 61194148 | 8/1986 |
| SU | 1748935 | 7/1992 |

* cited by examiner

*Primary Examiner*—Daniel Jenkins
(74) *Attorney, Agent, or Firm*—Burns, Doane, Swecker & Mathis, L.L.P.

(57) ABSTRACT

An improved method of making submicron cemented carbide bodies include wet milling powders of WC and Co and grain growth inhibitors to a slurry, drying the slurry to a powder, uniaxial pressing of the powder to form bodies of a desired shape, and sintering. WC powder is provided with an FSSS grain size, $d_{wc}$, of less than 1 $\mu$m and a Co powder with an FSSS grain size, $d_{co}$, such that the ratio $d_{wc}/d_{co}$ is 0.75–1.5.

21 Claims, No Drawings

METHOD OF MAKING SUBMICRON CEMENTED CARBIDE CUTTING TOOL INSERTS

BACKGROUND OF THE INVENTION

The following description contains references to certain compositions, articles and methods. However, these references should not necessarily be construed as an admission that such compositions, articles and methods constitute prior art under the applicable statutory provisions.

The manufacture of cemented carbides involves wet milling of powders forming a binder phase and hard constituents, drying the slurry to a powder, uniaxially pressing the powder into bodies of a desired shape, and finally, sintering. During sintering, the bodies shrink approximately 17–18% linearly. In general, the shrinkage is essentially isotropic both parallel to and perpendicular to the pressing direction. However, for submicron grades (i.e. in which essentially all of the WC grains are less than 1 μm) the shrinkage is anisotropic. The shrinkage parallel to the pressing direction is larger than that perpendicular thereto.

One way to define the character of the shrinkage is by means of the K-value according to the following formula:

$$K = \frac{hs * wp}{hp * ws}$$

where hs=the sintered height wp=the pressed width hp=the pressed height ws=the sintered width The height is defined as the dimension in the pressing direction and the width that direction perpendicular thereto.

For a completely isotropic shrinkage K=1.000. For submicron grades exhibiting anisotropic shrinkage K is less than 1.000. For the submicron grades the K value depends on the cobalt content. For submicron grades containing about 6 wt % Co, the K value is close to 1.000. For submicron grades containing 20 wt % Co, the K value is approximately 0.960.

One conventional way to characterize the average grain size of a powder is by means of the Fisher Sub-Sieve Sizer (FSSS). This apparatus employs the air permeability method in which the pressure drop over a certain amount of powder is registered and converted into an FSSS average grain size value.

U.S. Pat. No. 5,441,693 discloses the use of 0.4 μm Co-powder in a submicron WC with 6.5 and 6 wt % Co, respectively.

In JP 51-126 309 the manufacture of cemented carbide with a WC grain size of 0.5–0.8 μm, and 12 wt % Co with a grain size of 1 μm is disclosed.

EP-A-0 380 096 discloses the manufacture of a drill shank by mixing WC and Co powder having an average particle size of 0.5 μm. After sintering, the material has approximately 15–23 vol. % bond metal, or cobalt, and the average particle size of the hard phase or WC grains is 0.5–1.2 μm.

As already mentioned, the shrinkage is anisotropic for submicron cemented carbide grades. In order to compensate for this non-uniform shrinkage, special pressing tools have to be made for pressing of the submicron grades, which is a large disadvantage since pressing tools are expensive to produce. Alternatively, the sintered bodies have to be subjected to an extensive grinding operation which is expensive and time consuming.

SUMMARY OF THE INVENTION

It is therefore an object of the present invention to provide a method of avoiding special pressing tools or post-sintering grinding for the manufacture of submicron cemented carbides.

According to the present invention it has now surprisingly been found that the use of a cobalt powder with essentially the same grain size as the WC-powder results in a K-value approximately equal to 1.000.

DETAILED DESCRIPTION OF PREFERRED EMBODIMENTS

A preferred embodiment of the present invention relates to a submicron cemented carbide cutting tool in which essentially all of the WC grains are less than 1 μm, preferably 0.2 to 0.9 μm and with a cobalt content of 7.5 to 25 wt %, preferably 9 to 20 wt %, most preferably 10 to 15 wt %. In addition, the material contains up to 1 wt. % of conventional grain growth inhibitors such as carbides of tantalum, chromium and/or vanadium. In the case of tantalum carbide the material may contain up to 1.5 wt %.

According to preferred method of the present invention, a submicron cemented carbide cutting tool is manufactured by wet milling a slurry consisting of WC powder with an FSSS grain size, $d_{wc}$, of less than 1 μm, preferably 0.1 to 0.9 μm, and most preferably 0.2 to 0.8 μm, with Co powder in above mentioned amounts preferably with an FSSS grain size, $d_{co}$, of less than 1 μm such that the ratio $d_{wc}/d_{co}0.75<d_{wc}/d_{co}<1.5$, preferably $0.85<d_{wc}/d_{co}<1.3$, and most preferably $0.90<d_{wc}/d_{co}<1.2$. It is essential that the FSSS-value is determined on deagglomerated powders, since determination on agglomerated powders gives incorrect results. In addition, conventional grain growth inhibitors are added in above-mentioned amounts together with usual pressing aids.

The obtained slurry is dried to a powder with good flowability. This powder is uniaxially pressed in a pressing tool to a body of desired shape. Then, this body is sintered to form a desired article, such as a cutting tool insert. The pressing tool is the same as that used for making cemented carbides with medium to coarse WC grain size. The sintered body does not require any further grinding other than that generally necessary for corresponding medium to coarse grained grades.

EXAMPLE 1

(Prior Art)

A WC-10 wt % Co submicron cemented carbide was made by wet milling 300 g Co-powder (Westaim 2M) with an FSSS average grain size of 1.81 μm, 14.85 g $Cr_3C_2$ (H C Starck), 2683.1 g WC (H C Starck) with an FSSS average grain size of 0.83 μm, 2 g carbon black and 75 g PEG in 0.8 liters milling liquid consisting of ethylalcohol and water (70:30 by volume) for 40 h. The resulting slurry was spray-dried to a powder from which test samples were pressed at 171.6 MPa. The samples had the dimensions 15.39×15.39×6.51 $mm^3$. The latter dimension was parallel to the pressing direction. The samples were sintered at 1410° C. in Ar at a pressure of 4kPa. After sintering the samples had the dimensions 12.75×12.75×5.34 $mm^3$ resulting in a K-value of 0.990.

EXAMPLE 2

Example 1 was repeated with a Co-powder with an FSSS average grain size of 0.90 μm (Westaim ultra fine). The pressed test samples had in this case the dimensions 15.39×

15.39×6.54 $mm^3$. The sintered test samples had the dimensions 12.66×12.66×5.36 $mm^3$ resulting in a K-value of 0.996.

EXAMPLE 3

(Comparative)

A WC-20 wt % Co submicron cemented carbide was made in the same way as in Example 1 but with the use of a WC-powder with an FSSS average grain size of 0.4 μm (H C Starck) and a Co-powder with an FSSS average grain size of 2 μm (OMG). A K-value of 0.964 was obtained.

EXAMPLE 4

Example 3 was repeated but with a Co-powder with an FSSS average grain size of 0.4 μm (ETP). A K-value of 0.988 was obtained.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents which fall within the spirit and scope of the invention be embraced thereby.

What is claimed is:

1. A method of making a submicron cemented carbide body comprising wet milling powders of WC and Co and grain growth inhibitors to form a slurry, drying said slurry to form a powder, uniaxially pressing the powder to form a body of a desired shape, and sintering said body such that the sintered cemented carbide body has a Co-content of 7.5–25 wt % and that the WC grains have an FSSS grain size, $d_{WC}$, of less than 1 μm and the Co has an FSSS grain size, $d_{CO}$, of less than 1 μm, such that the ratio $d_{WC}/d_{Co}$ is $0.75<d_{WC}/d_{Co}<1.5$, wherein said body has a K value of at least 0.988, wherein the K value is defined as:

$$K = \frac{hs * wp}{hp * ws}$$

wherein hs=sinterd height of the body;

wp=pressed width of the body;

hp=pressed height of the body; and ws=sintered width of the body.

2. The method according to claim 1 wherein the Co-content of said sintered body is 9–20 wt %.

3. The method according to claim 1 wherein the Co-content of said sintered body is 10–15 wt %.

4. The method according to any one of the preceding claims wherein the ratio of said sintered body $d_{wc}/d_{co}$ is $0.85<d_{wc}/d_{co}<1.3$.

5. The method according to one of claims 1 to 3 wherein the ratio of said sintered body $d_{wc}/d_{co}$ is $0.90<d_{wc}/d_{co}<1.2$.

6. The method of claim 1, further comprising uniaxially pressing the powder to form a cutting tool insert.

7. The method of claim 1, wherein the grain growth inhibitors are added in an amount of up to 1 wt %.

8. The method of claim 1, wherein the grain growth inhibitor comprises 1.5 wt. % tantalum carbide.

9. The body of claim 1, wherein said K value is at least 0.990.

10. The body of claim 1, wherein said K value is at least 0.996.

11. The body of claim 1, wherein said body comprises a cutting tool insert.

12. A method of making a submicron cemented carbide body comprising wet milling powders of WC and Co and grain growth inhibitors to form a slurry, drying said slurry to form a powder, uniaxially pressing the powder to form a body of a desired shape, and sintering said body such that the sintered cemented carbide body has a Co-content of 7.5–25 wt % and that the WC grains have an FSSS grain size, $d_{wc}$, of less than 1 μm and the Co has an FSSS grain size, $d_{co}$, of less than 1 μm, such that the ratio $d_{wc}/d_{Co}$ is $0.85<d_{WC}/d_{Co}<1.5$, wherein said body has a K value of at least 0.988, wherein the K value is defined as:

$$K = \frac{hs * wp}{hp * ws}$$

wherein hs=sinterd height of the body;

wp=pressed width of the body;

hp=pressed height of the body; and ws=sintered width of the body.

13. The method according to claim 12 wherein the ratio of said sintered body $d_{wc}/d_{co}$ is $0.85<d_{wc}/d_{co}<1.3$.

14. The method according to claim 12 wherein the ratio of said sintered body $d_{wc}/d_{co}$ is $0.90<d_{wc}/d_{co}<1.2$.

15. The method of claim 12, further comprising uniaxially pressing the powder to form a cutting tool insert.

16. A cemented carbide body made by a method comprising wet milling powders of WC and Co and grain growth inhibitors to form a slurry, drying said slurry to form a powder, uniaxially pressing the powder to form a body of a desired shape, and sintering said body such that the sintered cemented carbide body has a Co-content of 7.5–25 wt % and that the WC grains have an FSSS grain size, $d_{WC}$, of less than 1 μm and the Co has an FSSS grain size, $d_{co}$, of less than 1 μm, such that the ratio $d_{WC}/d_{Co}$ is $0.75<d_{WC}/d_{Co}<1.5$, wherein said body has a K value of at least 0.988, wherein the K value is defined as:

$$K = \frac{hs * wp}{hp * ws}$$

where hs=sintered height of the body;

wp=pressed width of the body;

hp=pressed height of the body; and ws=sintered width of the body.

17. The body of claim 16, wherein said K value is at least 0.990.

18. The body of claim 16, wherein said K value is at least 0.996.

19. The body of claim 16, wherein said body comprises a cutting tool insert.

20. The body of claim 16, wherein the ratio $d_{WC}/d_{Co}$ is $0.85<d_{WC}/d_{Co}<1.3$.

21. The body of claim 16, wherein the ratio $d_{WC}/d_{Co}$ is $0.90<d_{WC}/d_{Co}<1.2$.

* * * * *